US012650002B2

(12) United States Patent
Fedirko

(10) Patent No.: US 12,650,002 B2
(45) Date of Patent: Jun. 9, 2026

(54) HANDLING APPARATUS FOR GRADER SNOW WING ATTACHMENT

(71) Applicant: Richard Allen Fedirko, Sylvania (CA)

(72) Inventor: Richard Allen Fedirko, Sylvania (CA)

( * ) Notice: Subject to any disclaimer, the term of this patent is extended or adjusted under 35 U.S.C. 154(b) by 371 days.

(21) Appl. No.: 18/493,920

(22) Filed: Oct. 25, 2023

(65) Prior Publication Data

US 2024/0175236 A1 May 30, 2024

(30) Foreign Application Priority Data

Nov. 30, 2022 (CA) ..... CA 3183103

(51) Int. Cl.
*E02F 3/96* (2006.01)
*E02F 3/76* (2006.01)

(52) U.S. Cl.
CPC ..... *E02F 3/968* (2013.01); *E02F 3/76* (2013.01)

(58) Field of Classification Search
None
See application file for complete search history.

(56) References Cited

U.S. PATENT DOCUMENTS 5,899,007 A * 5/1999 Niemela ..... E01H 5/066 37/234
2006/0143952 A1* 7/2006 Lannert ..... E01H 5/067 37/268
2020/0354910 A1* 11/2020 Niemela ..... E01H 5/068

* cited by examiner

*Primary Examiner* — Christopher J Sebesta
*Assistant Examiner* — Alfred H Tsui
(74) *Attorney, Agent, or Firm* — Ryan W. Dupuis; Kyle R. Satterthwaite; Ade & Company Inc.

(57) ABSTRACT

A handling apparatus a grader wing blade attachment having a pivot connecting a front end of the wing blade to the grader and support arms connecting a rear end of the wing blade to the grader. The handling apparatus has a wheeled base and first and second mounts that carry the support arms for rolling movement relative to the ground as the support arms are pivoted relative to the wing blade for attaching and removing the support arms relative to the grader. A lift arrangement allows a height of the mounts to be adjusted for aligning the support arms with respective mounting locations on the grader. An additional wing blade stand mates with a lift hook aperture on the rear of the wing blade and includes legs for engaging the ground to support the wing blade in an upright orientation when detached from the grader.

18 Claims, 4 Drawing Sheets

HANDLING APPARATUS FOR GRADER SNOW WING ATTACHMENT

This application claims foreign priority benefits from Canadian Patent Application 3,183,103, filed Nov. 30, 2022.

FIELD OF THE INVENTION

The present invention relates to an apparatus for handling a snow wing attachment for a grader, and more particularly, the present invention relates to a handling apparatus arranged for rolling movement across the ground while supporting the connecting arms of a grader snow wing attachment thereon.

BACKGROUND

Graders are well known implements in which a wheeled vehicle supports an elongate grader blade spanning generally laterally across the ground at an intermediate location between front and rear wheels of the grader. The grader blade is typically positioned against the ground while being sloped laterally and rearwardly to one side of the grader for discharging material collected from the ground by the grader blade in a windrow offset to one side of the grader.

In some instances, a grader wing attachment is provided as an auxiliary wing blade that mounts rearwardly of the trailing end of the grader blade to extend rearwardly and laterally outward to an outer end of the wing blade that is positioned further outward from the grader than the trailing end of the grader blade. The grader wing attachment, sometimes referred to as a snow wing, serves to locate the windrow of material collected by the grader blade at a location further outward to the side of the grader. The grader wing attachment can also be used independently of the grader blade to clear a path alongside the travel path grader, for example for pushing material laterally outwardly from the shoulder of a roadway while the grader travels along the roadway.

A typical grader wing attachment includes (i) a pivot connection at a first end of the wing blade for pivotal connection of the first end of the wing blade to the grader at a location in proximity to the trailing end of the grader blade, and (ii) first and second support arms connecting a second end of the wing blade to the grader at a location spaced rearwardly of the pivot connection. The first and second support arms typically comprises telescoping members for adjusting (i) the lateral distance of the second end of the wing blade from the grader and (ii) a height of the second end of the wing blade to displace the wing blade between a working position or a stored position alongside the grader. One of the support arms typically comprises a telescoping frame member, while another one of the support arms typically comprises a lift actuator connected to an innermost section of the telescoping frame member for adjusting height of the telescoping frame member. These support arms are very heavy and difficult for an individual operator to manually attach and remove from the grader when it is desired to use or store the grader wing attachment.

SUMMARY OF THE INVENTION

According to one aspect of the invention there is provided a handling apparatus for a grader wing attachment including a wing blade, a pivot at a first end of the wing blade for pivotal connection to a grader, and first and second support arms for connecting a second end of the wing blade to the grader at a location spaced rearwardly of the pivot, the apparatus comprising:

- a wheeled base arranged for rolling movement along the ground in a rolling direction;
- an upright frame extending upwardly from the wheeled base;
- a first mount supported on the upright frame at a location spaced above the wheeled base, the first mount being arranged to support the first support arm of the grader wing attachment extending along a first axis of the first mount; and
- a second mount supported on the upright frame at a location spaced above the first mount, the second mount being arranged to support the second support arm of the grader wing attachment extending along a second axis of the second mount;
- wherein the rolling direction of the wheeled base is oriented transversely to the first and second axes of the first and second mounts.

The arrangement of the first and second mounts which support the first and second support arms one above the other on a wheeled base, allow the weight of the support arms to be carried on the handling apparatus while maintaining the ability of the support arms to be displaced towards the grader for mounting the attachment onto the grader or away from the grader when separating the attachment from the grader. This greatly simplifies the process of attachment or removal of a wing attachment relative to a grader, while reduces stress and potential injury to the operator. When further providing a lift arrangement between the first and second mounts and the wheeled base, the supported height of the first and second support arms can also be readily adjusted to readily align the support arms with respective mounting locations at the rear of the grader.

When the wheeled base comprises a pair of wheels spaced apart from one another in the rolling direction, the wheels may be oriented along a common arc shaped path having a radius of curvature which corresponds approximately to a length that the first and second arms extend from the wing blade.

The upright frame preferably includes a lifting arrangement enabling the first and second mounts to be adjusted in height relative to the wheeled base. In this instance, the lifting arrangement may comprise (i) a post having first and second telescoping sections, (ii) a screw mechanism operatively connected between the first and second telescoping sections to extend and retract the first and second telescoping sections relative to one another, and (iii) a manually operated crank arranged for driving rotation of the screw mechanism.

Preferably the first mount comprises a cradle having an open top end arranged to receive the first support arm of the wing attachment at least partially recessed into the cradle through the open top end.

Similarly, the second mount preferably comprises a cradle having an open top end arranged to receive the second support arm of the wing attachment at least partially recessed into the cradle through the open top end.

The first and second support arms may be arranged to be mounted at first and second mounting locations on the grader respectively in which the first and second mounting locations are vertically spaced apart by a prescribed distance. In this instance, the first mount and the second mount may be vertically spaced apart on the upright frame by a vertical distance corresponding to said prescribed distance.

In one embodiment, the first axis of the first mount and the second axis of the second mount are aligned with one another within a substantially vertical common plane. In an alternative embodiment, the first mount protrudes laterally outwardly from the upright frame by a greater distance than the second mount protrudes laterally outwardly from the upright frame. The different embodiments are suited for supporting the support arms of different brands of the wing blade attachment respectively.

The upright frame may comprise a singular pole extending upwardly from the wheeled base.

The apparatus may be used in combination with a wing blade stand arranged to support the wing blade relative to a ground surface, in which the wing blade stand comprises:

an arm extending longitudinally between an inner first end and an outer second end, the outer second end being sized for insertion into a lift hook aperture on a rear of the wing blade; and at least one leg connected to the inner first end of the arm to extend downwardly and laterally outwardly away from the arm when the arm is horizontally inserted into the lift hook aperture of the wing blade;

said at least one leg having a height which is sized to support the wing blade in a vertical orientation on the ground surface when said at least one leg is engaged upon the ground surface.

According to a second aspect of the present invention there is provided a method of handling a grader wing attachment relative to a grader in which the grader wing attachment includes a wing blade, a pivot at a first end of the wing blade for pivotal connection to the grader, and first and second support arms for connecting a second end of the wing blade to the grader at a location spaced rearwardly of the first pivot, the method comprising:

providing a handling apparatus as described above;

supporting the first support arm of the grader wing attachment within the first mount so that the first support arm extends along a first axis of the first mount;

supporting the second support arm of the grader wing attachment within the second mount so that the second support arm extends along a second axis of the second mount; and rolling the wheeled base transversely to the first and second axes of the first and second mounts so as to pivot the support arms relative to the wing blade and thereby displace the first and second support arms towards or away from the grader.

When the wheeled base comprises a pair of wheels spaced apart from one another in the rolling direction in which the wheels are oriented along a common arc shaped path having a radius of curvature, the method may further include supporting the first and second support arms in the first and second mounts at a distance along the support arms from the wing blade that is equal to said radius of curvature.

The method may further comprise using a lifting arrangement of the upright frame to vary a height of the first and second mounts relative to the wheeled base to align the first and second support arms with respective mounting locations for the first and second support arms on the grader.

When providing a wing blade stand arranged to support the wing blade relative to a ground surface, in which the wing blade stand includes (i) an arm extending longitudinally between an inner first end and an outer second end, and (ii) at least one leg connected to the inner first end of the arm to extend downwardly and laterally outwardly away from the arm when the arm is horizontally oriented, the method may further include (i) inserting the outer second end of the arm into a lift hook aperture on a rear of the wing blade, and (ii) engaging said at least one leg on the ground surface such that the wing blade is supported by the wing blade in a vertical orientation on the ground surface.

According to a further aspect of the present invention there is provided a wing blade stand for a grader attachment comprising a wing blade for supporting the wing blade relative to a ground surface, the wing blade stand comprising:

an arm extending longitudinally between an inner first end and an outer second end, the outer second end being sized for insertion into a lift hook aperture on a rear of the wing blade; and at least one leg connected to the inner first end of the arm to extend downwardly and laterally outwardly away from the arm when the arm is horizontally inserted into the lift hook aperture of the wing blade;

said at least one leg having a height which is sized to support the wing blade in a vertical orientation on the ground surface when said at least one leg is engaged upon the ground surface.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
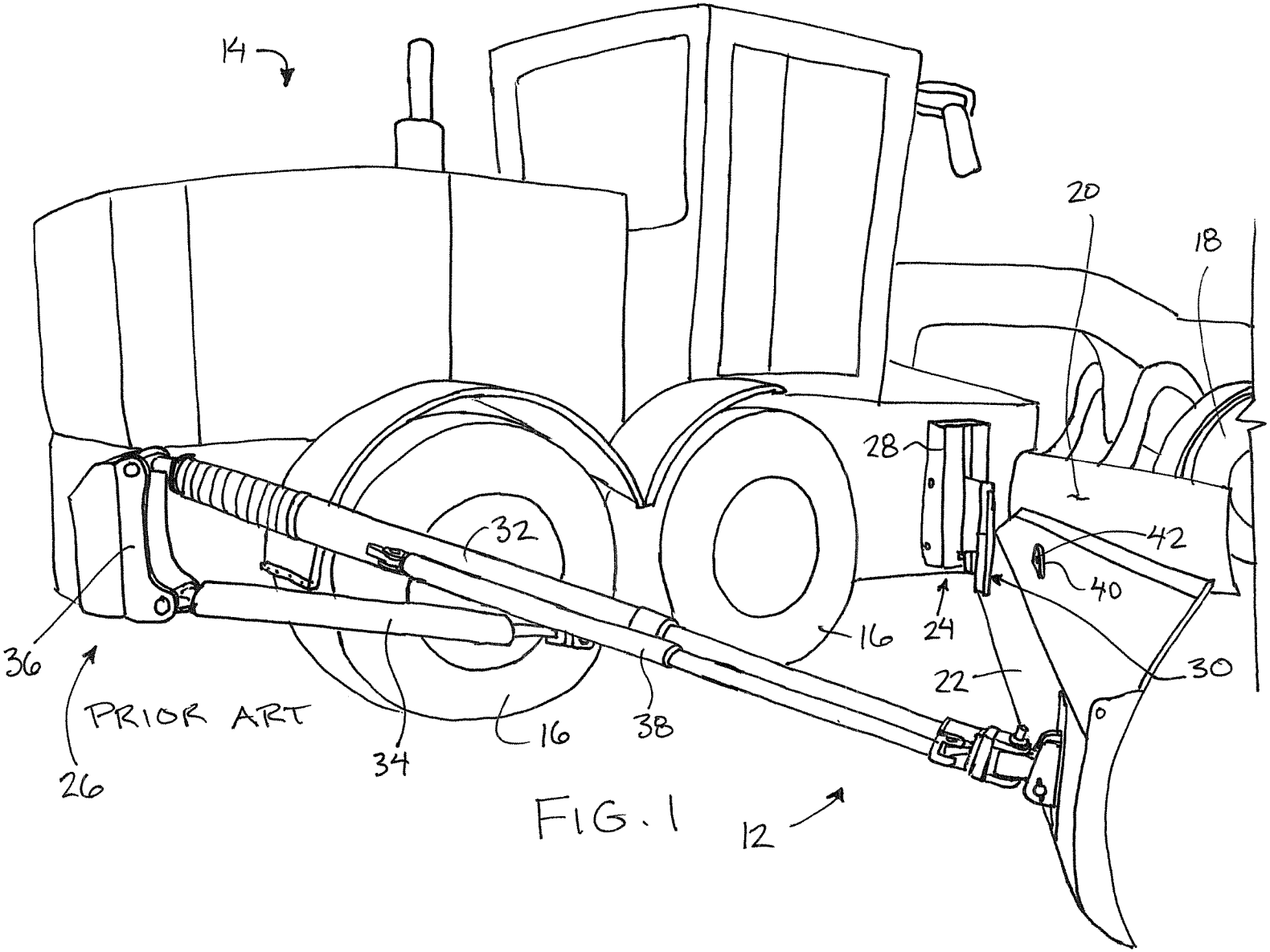
FIG. 1 is a perspective view of a prior art grader wing attachment shown supported on a conventional grader.

Referring to the accompanying figures, there is illustrated a grader wing attachment handling apparatus generally indicated by reference numeral 10. The handling apparatus 10 is particularly suited for use in mounting and removing a wing attachment 12 relative to a grader implement 14.

According to the illustrated example, the grader implement 14 comprises a wheeled vehicle having rear wheels 16 at a rear end and front wheels 18 at a front end with a main grader blade 20 suspended from a frame of the vehicle at an intermediate location between the front and rear wheels. The main grader blade 20 is supported to be adjustable about various axes, but under normal use is commonly oriented to span laterally across the width of the vehicle often at a rearward slope from one side of the vehicle to the other in the lateral direction for collecting material from a roadway to redirect the material into a windrow offset laterally to one side of the vehicle as material is discharged from the trailing end of the main grader blade.

When a wing attachment 12 is used, the wing attachment is typically mounted rearwardly of the trailing edge of the main grader blade 20 to receive material discharged from the main grader blade and redirect the material laterally further outward from the vehicle. In the illustrated example, the wing attachment 12 comprises a wing blade 22 extending rearwardly and laterally outwardly from the vehicle when mounted on the frame of the vehicle. The wing blade 22 is supported relative to the vehicle frame at an inner end by a forward mounting arrangement 24 and relative to the vehicle frame at an outer end by a rearward mounting arrangement 26.

The forward mounting arrangement 24 includes a front bracket 28 mounted on the vehicle frame and a pivot connection 30 forming a connection between the front bracket 28 and a mounting aperture at the forward or inner end of the wing blade 22. The pivot connection 30 is controllably adjustable in height along the front bracket and serves to support the front end of the wing blade for pivotal movement about a vertical pivot axis as the opposing rear end of the wing blade is displaced towards and away from the vehicle frame and about a horizontal axis perpendicular to the face of the wing blade to control upward inclination of the wing blade from the inner end to the outer end of the wing blade.

The rearward mounting arrangement 26 includes an upper support arm 32 and a lower support arm 34 connected to respective first and second mounting locations on a rear bracket 36 that is mounted on the rear end of the vehicle frame. The first and second mounting locations on the rear bracket are vertically spaced apart from one another by a prescribed distance.

In the illustrated embodiment, the upper arm 32 is a primary frame member including inner and outer frame sections which are telescopically connected to vary the overall length of the upper arm between an inner end pivotally coupled at the respective mounting location on the rear bracket and an outer end pivotally mounted on the outer end of the wing blade at the rear side thereof. An extension actuator 38 is mounted alongside the upper arm between the first and second frame sections thereof to controllably vary the length of the upper arm.

The lower arm 34 in this instance defines a lift actuator operatively connected between the respective lower mounting location on the rear bracket 36 and the inner frame section of the upper arm such that extension and retraction of the length of the lower arm controllably varies the height of the outer end of the upper arm which in turn varies the supported height of the outer end of the wing blade.

In an alternative type of wing attachment (not shown), the lower support arm may define a primary telescoping frame member that supports the outer end of the wing blade while the upper arm instead defines a lift actuator operatively connected between the vehicle frame and the innermost section of the lower arm for controlling height of the outer end of the wing blade.

The wing blade 22 is further provided a supporting flange 40 on the rear face of the wing blade at a central location between longitudinally opposed ends of the blade in proximity to the top end of the blade. The flange includes a lift hook aperture 42 formed therein through which a lift hook can be engaged so that the wing blade can be suspended from the lift hook for handling of the wing blade if desired.

The handling apparatus 10 according to the present invention generally includes (i) a wheeled base 50 arranged for rolling movement along the ground in a prescribed rolling direction, (ii) an upright frame 52 extending upwardly from the wheeled base, (iii) a lower mount 54 carried on the upright frame 52 for supporting the lower support arm 34 therein, and (iv) an upper mount 56 located on the upright frame at a location spaced above the lower mount for supporting the upper support arm 32 therein. The upright frame 52 in the illustrated embodiment further includes a lift arrangement incorporated therein so that the upper mount 56 and the lower mount 54 can be raised and lowered in height relative to the wheeled base.

The lift arrangement may be manually operated using a mechanical advantage, or alternatively a powered drive may assist in lifting the mounts 54 and 56 with the support arms mounted thereon relative to the wheeled base using hydraulic or electric actuators for example.

The wheeled base 50 comprises an elongated rigid beam 58 extending longitudinally between opposing ends of the beam which support a first wheel 60 and a second wheel 62 respectively thereon. The wheels are oriented for rolling movement along the ground generally in a longitudinal direction of the beam. More particularly, the wheels are arranged such that the rolling direction of the wheels are aligned along a common arcuate path having a prescribed radius of curvature. The radius of curvature of the arcuate path of the wheels is approximately equal to a length of the upper arm 32 when retracted in length. In this matter, when the inner ends of the upper and lower support arms are supported in the mounts of the apparatus 10 and the support arms are pivoted relative to the wing blade, the wheels are suited for rolling along the arcuate path defined by the inner ends of the support arms swinging relative to the wing blade. In this manner, it is desirable to support the inner ends of the support arms on the apparatus such that the apparatus 10 is positioned at a radial distance from the wing blade corresponding approximately to the radius of curvature of the arcuate path of the first and second wheels 60 and 62.

The upright frame 52 in the illustrated embodiment comprises a singular pole or post incorporating the lift arrangement therein. More particularly, the lift arrangement comprises an upper telescopic frame section 64 receiving a lower telescoping frame section 66 therein for relative telescoping movement. The lower telescopic frame section 66 is fixed relative to the rigid beam 58 of the wheeled base while the upper telescopic section 64 is raised and lowered relative to the wheeled base by the telescopic connection with the lower frame section 66.

In the preferred embodiment, the lift arrangement is manually operated while providing a mechanical advantage. The lift arrangement includes a manual crank arm 68 mounted at the top end of the upright frame. The crank arm 68 includes a handle arranged to be gripped in the hand of a user so that the crank can be rotated about a horizontal axis relative to the upright frame. The manual crank arm 68 is operatively connected to a vertical screw (not shown) supported within the telescopic frame sections 64 and 66 through a set of bevel gears connected between the screw and the crank arm. The screw is fixed in height relative to the upper frame section 64 by a set of internal bearings operatively connected between the screw and the upper frame section so that the screw is rotatable about a vertical axis of the screw relative to the surrounding upper frame section 64. A nut (not shown) is mounted internally within the lower telescopic frame section 66 and includes an internally threaded bore which forms a threaded connection with the screw that is received through the nut. The nut is fixed relative to the lower telescopic frame section 66. Accordingly, when the screw is rotated by the manual crank arm 68, the screw is longitudinally displaced relative to the nut which in turn raises or lowers the upper telescopic frame section 64 relative to the lower telescopic frame section 66.

The lower mount 54 and the upper mount 56 are similar in configuration in that each defines a cradle comprised of a generally U-shaped trough having an open top end. More particularly, each mount includes two upright members 70 connected by a bottom member 72 between the bottom ends of the upright members 70 so as to form a U-shaped trough extending about a respective axis that is generally horizontal and perpendicular to the arcuate path defined by the rolling direction of the wheels. Each cradle remains open at the top end thereof across the full width of the cradle in the lateral direction between the two upright members 70 thereof. The dimension in the lateral direction is equal to or slightly greater than the corresponding dimensions of the upper or lower arm to be received within the respective mount. In use, the upright frame is typically positioned in a substantially vertical orientation with the upper and lower arms 32 and 34 being received within the upper mount 56 and the lower mount 54 thereof such that the respective arms are aligned with upper axis of the cradle of the upper mount 56 and the lower axis of the cradle of the lower mount 54 respectively.

The upper mount is typically mounted on the upright frame at a location spaced above the lower mount such that a vertical distance between the upper and lower mounts 56 and 54 is approximately equal to the prescribed vertical distance between the first and second mounting locations of the support arms on the rear bracket 36 so that the support arms can be supported on the upright frame for alignment with the respective mounting locations on the rear bracket.

Figure 2:
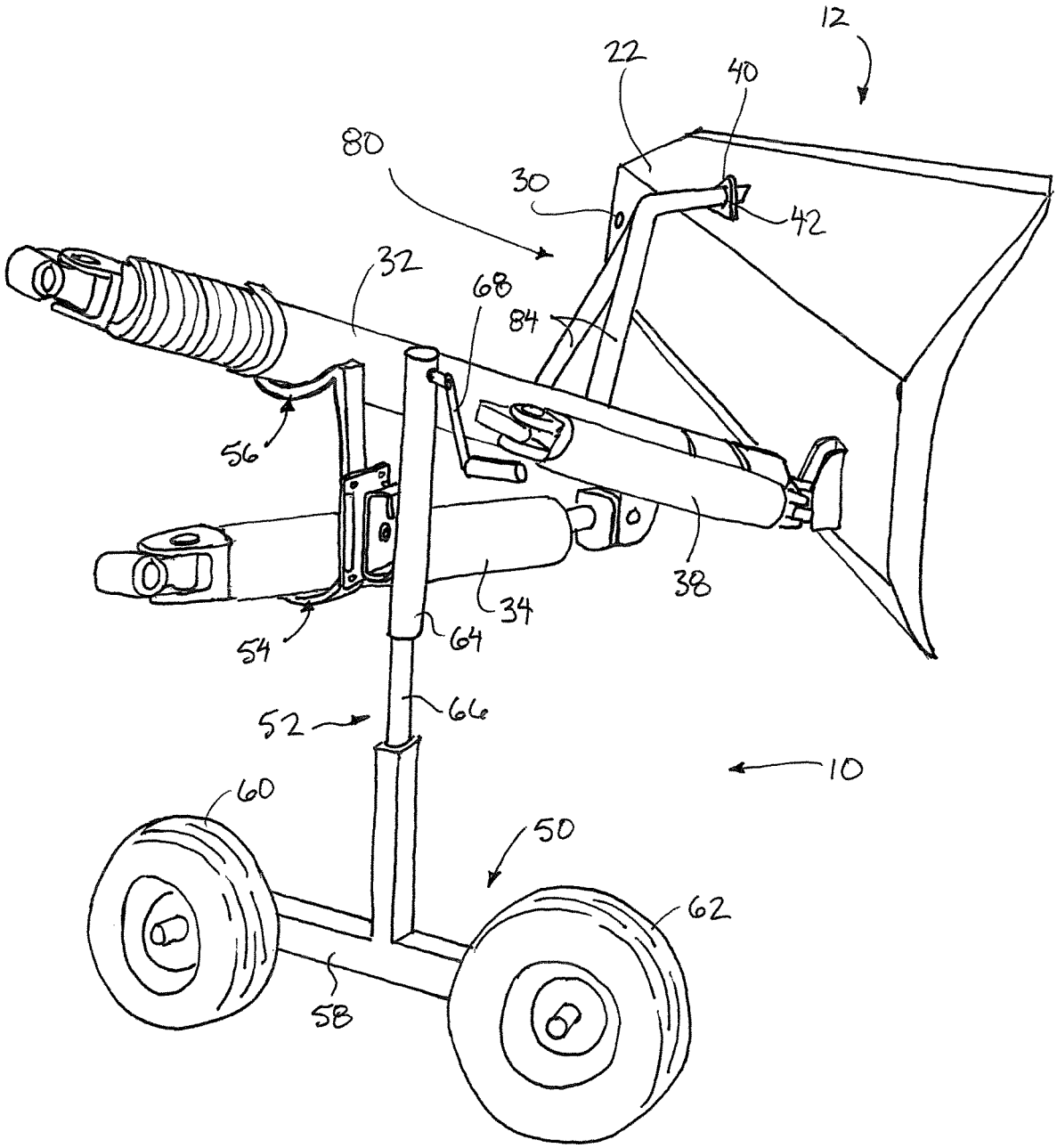
FIG. 2 is a perspective view of the support arms of the grader wing attachment according to FIG. 1 shown separated from the grader and supported on the handling apparatus according to the present invention in which the wing blade is further shown supported by a wing blade stand.
Figure 3:
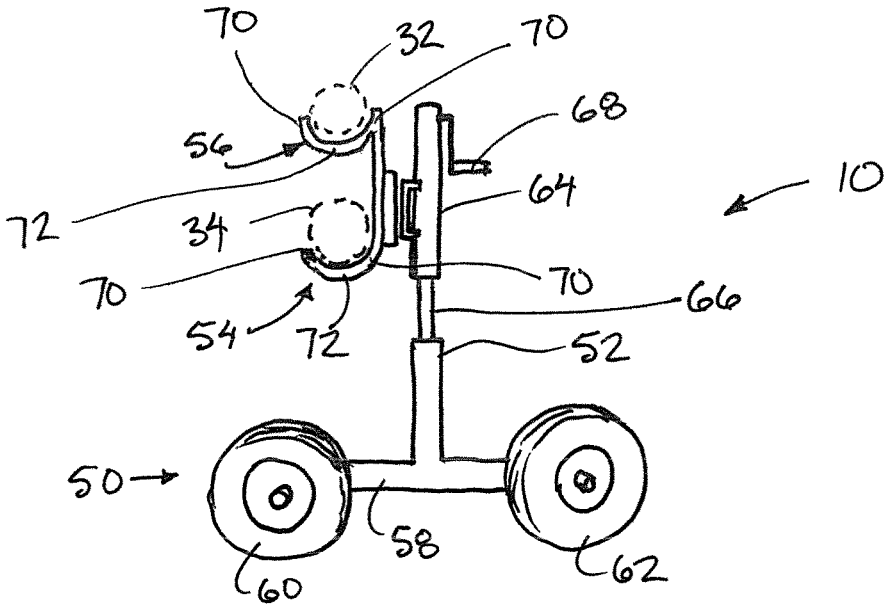
FIG. 3 is a side elevational view of the handling apparatus according to FIG. 2.
Figure 4:
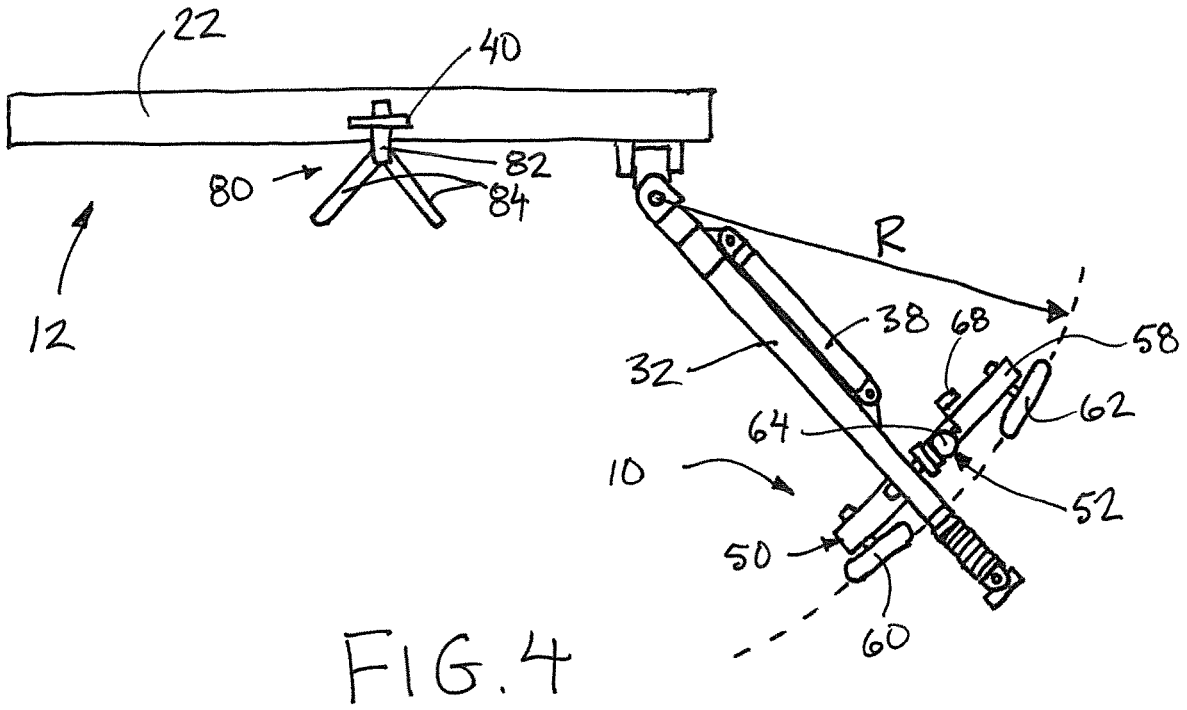
FIG. 4 is a top plan view of the grader wing attachment according to FIG. 2 in which the support arms of the attachment are supported in the first and second mounts of the handling apparatus and the wing blade of the attachment is supported by the wing blade stand.

Turning initially to the first embodiment shown in FIGS. 2 through 4, the upper mount 56 and the lower mount 54 in this instance are substantially identical in shape and size while the upper axis of the upper mount and the lower axis of the lower mount lie in a common vertical plane due to the upper mount being located directly above the lower mount. Both mounts of the first embodiment shown in FIGS. 2 through 4 also have a curved bottom member 72 forming a concave cradle that is curved about the axis of the respective mount. The arrangement of the upper and lower mounts in this instance is suited for cooperation with support arms 32 and 34 of the type shown in FIGS. 1 and 2.

Figure 6:
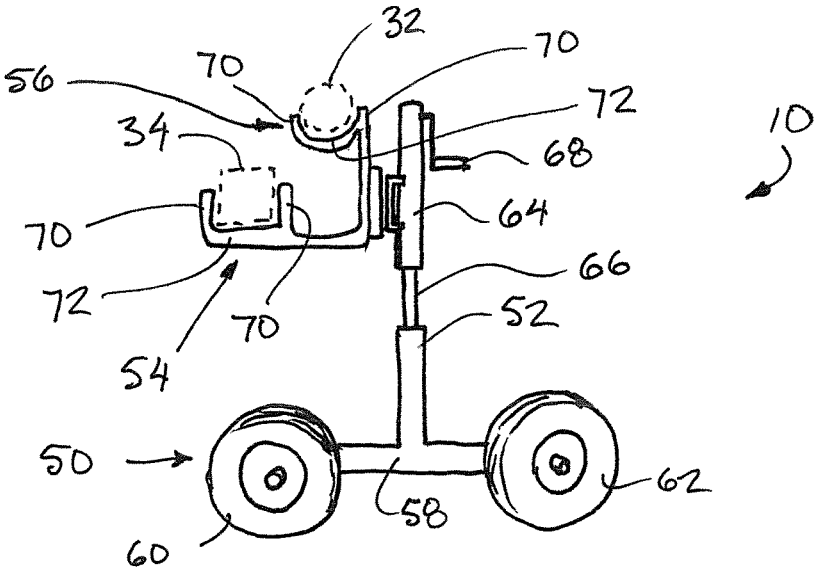
FIG. 6 is a side elevational view of the handling apparatus according to second embodiment.

Turning now to the second embodiment shown in FIG. 6, in this instance the lower mount 54 may protrude laterally outward from the upright frame by a greater distance than the upper mount 56. In addition, the cradle of the lower mount 54 in this instance has a greater lateral dimension than the upper mount while also having a more rectangular shape. The bottom member 72 of the lower mount is substantially flat between vertical upright members 70. The lower mount 54 in this instance thus differs in configuration from the curved bottom member 72 forming a concave cradle of the upper mount 56 of the second embodiment. The apparatus according to the second embodiment of FIG. 6 is suited for a different brand of wing attachment which instead has a lower support arm defining the primary frame member that supports the outer end of the wing attachment while the upper support arm comprises a lift cylinder used to adjust the height of the lower support arm.

Figure 5:
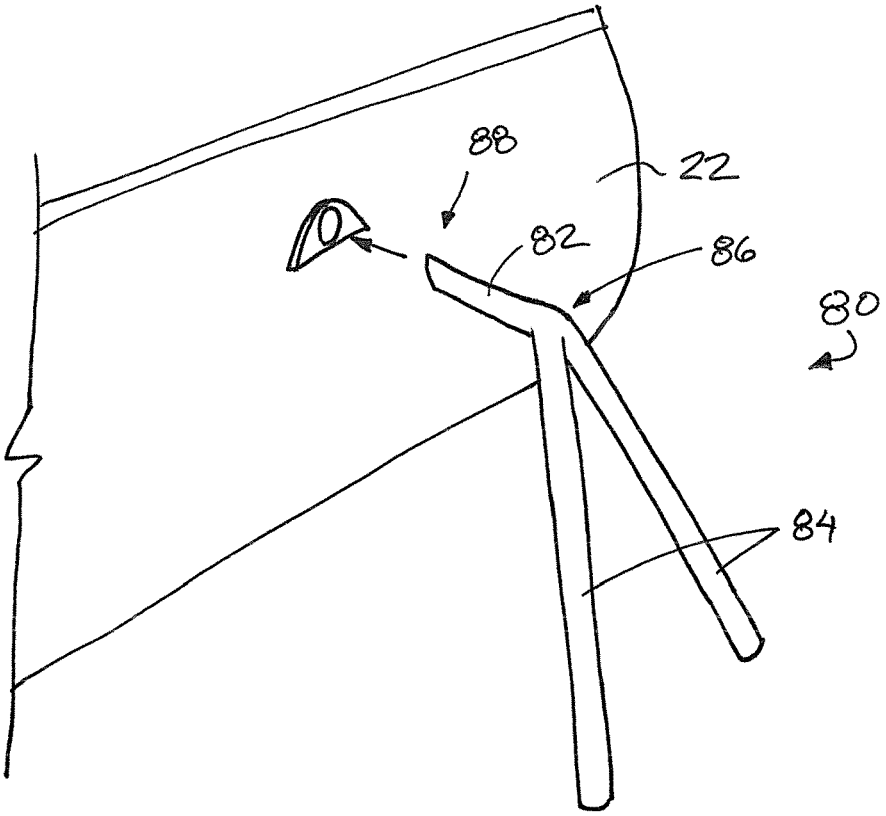
FIG. 5 is a perspective view of the wing blade stand shown separated from the wing blade of the grader wing attachment.

The handling apparatus 10 described herein is particularly suited for use in combination with a wing blade stand 80 as shown in FIGS. 2, 4, and 5. The wing blade stand 80 is arranged for supporting the wing blade of the wing attachment when the wing blade is removed from the grader.

The stand 80 generally includes an arm 82 at the top end thereof and one or more legs 84 extending downwardly from one end of the arm 82. In use, the arm 82 is intended to extend horizontally between an inner end 86 and an outer end 88 of the arm. The arm comprises a tubular member having a diameter which is equal to or less than the internal dimensions of the lift hook aperture of the wing blade to enable the outer end of the arm 82 to be inserted horizontally into the lift hook aperture when the wing blade is supported on a ground surface in a vertical orientation. The vertical orientation of the wing blade is defined as an orientation of the blade when a top edge and a bottom edge of the blade lie in a substantially common vertical plane.

The legs 84 are connected to the inner end of the arm 82 to extend downwardly at an outward slope away from the outer end of the arm 82 and away from the wing blade when the arm is horizontally inserted into the lift hook aperture at the rear of the wing blade. In the illustrated embodiment, two legs 84 extend downwardly from the arm in diverging relation forming an interior angle of approximately between 20 and 40 degrees for example. The legs have a similar length so that both legs engage the ground that supports the wing blade thereon when the wing blade is in the vertical orientation and the arm 82 is horizontally inserted into the lift hook aperture of the wing blade. The two legs 84 lie in a common plane which is sloped downwardly and away from the wing blade when the arm is horizontally inserted into the lift hook aperture. For example, the legs may lie within a plane forming an interior angle of greater than 90 degree with the arm, and more preferably within the range of between 100 and 130 degrees.

When removing the wing attachment 12 from the grader 14, the wing blade is initially lowered to the ground using the forward and rearward mounting arrangements of the wing attachment with the telescoping support arm being retracted in length. The handling apparatus 10 is then positioned in proximity to the inner ends of the support arms adjacent to the grader and the wheels are oriented in a rolling direction which is substantially perpendicular to the longitudinal axes of the support arms. The lift arrangement of the handling apparatus 10 is adjusted to position the upper and lower mounts 56 and 54 directly below the upper and lower support arms respectively. The support arms are then each detached from the rear bracket on the grader and positioned within the respective mounts on the handling apparatus. Each support arm is inserted into the open top of the cradle of the respective mount such that the support arm is partly or fully recessed into the trough shape of the cradle. The shape of the cradle aligns the longitudinal axis of each support arm with the axis of the respective mount on the handling apparatus. With the support arms detached from the rear bracket on the grader, the inner ends of the support arm can be pivoted away from the grader by rolling the wheels along the ground along the prescribed arcuate shaped path of the wheels, in which the arcuate path is centred at the outer end of the support arm that is pivotally coupled to the rear of the outer end of the wing blade. The wing blade stand 80 is then coupled to the wing blade by inserting the outer end of the arm 82 into the lift hook aperture so that the arm 82 protrudes horizontally rearward from the wing blade and the legs 84 are sloped downwardly and outwardly from the rear of the wing blade for engaging the ground and maintaining the wing blade supported in the vertical orientation relative to the ground. The pivotal connection 30 of the forward mounting arrangement can then be disconnected to fully separate the wing blade from the grader.

When it is desired to subsequently mount the wing blade onto the grader implement, the reverse operations are performed by initially positioning the grader so that the front bracket is in proximity to the inner end of the wing blade to permit the inner end of the wing blade to be attached to the forward mounting arrangement on the grader. The wing blade stand 80 can then be removed from the wing blade as the upright orientation of the wing blade is maintained by the forward mounting arrangement of the wing attachment. With the support arms stored on the handling apparatus 10, the handling apparatus is rolled along the ground to displace the inner ends of the support arms towards the rear bracket on the grader for subsequent connection of the support arms to the rear bracket on the grader. The lift arrangement of the handling apparatus 10 can be used to adjust the height of the inner ends of the support arms to align the support arms with the respective mounting locations on the rear bracket. Once the support arms are connected to the respective mounting locations on the rear bracket, the handling apparatus can be separated from the wing attachment and stored for later reuse when the wing blade is again to be separated from the grader for storage.

Since various modifications can be made in the invention as herein above described, and many apparently widely different embodiments of same made, it is intended that all matter contained in the accompanying specification shall be interpreted as illustrative only and not in a limiting sense.

The invention claimed is:

1. A handling apparatus for a grader wing attachment including a wing blade, a pivot at a first end of the wing blade for pivotal connection to a grader, and first and second support arms for connecting a second end of the wing blade to the grader at a location spaced rearwardly of the pivot, the apparatus comprising:

a wheeled base arranged for rolling movement along the ground in a rolling direction;

an upright frame extending upwardly from the wheeled base;

a first mount supported on the upright frame at a location spaced above the wheeled base, the first mount being arranged to support the first support arm of the grader wing attachment extending along a first axis of the first mount; and a second mount supported on the upright frame at a location spaced above the first mount, the second mount being arranged to support the second support arm of the grader wing attachment extending along a second axis of the second mount;

wherein the rolling direction of the wheeled base is oriented transversely to the first and second axes of the first and second mounts;

wherein the upright frame includes a lifting arrangement enabling the first and second mounts to be adjusted in height relative to the wheeled base.

2. The apparatus according to claim 1 wherein the wheeled base comprises a pair of wheels spaced apart from one another in the rolling direction, the wheels being oriented along a common arc shaped path having a radius of curvature which corresponds approximately to a length that the first and second arms extend from the wing blade.

3. The apparatus according to claim 1 wherein the lifting arrangement comprises (i) a post having first and second telescoping sections, (ii) a screw mechanism operatively connected between the first and second telescoping sections to extend and retract the first and second telescoping sections relative to one another, and (iii) a manually operated crank arranged for driving rotation of the screw mechanism.

4. The apparatus according to claim 1 wherein the first mount comprises a cradle having an open top end arranged to receive the first support arm of the wing attachment at least partially recessed into the cradle through the open top end.

5. The apparatus according to claim 1 wherein the second mount comprises a cradle having an open top end arranged to receive the second support arm of the wing attachment at least partially recessed into the cradle through the open top end.

6. The apparatus according to claim 1 wherein the first and second support arms are arranged to be mounted at first and second mounting locations on the grader respectively in which the first and second mounting locations are vertically spaced apart by a prescribed distance, and wherein the first mount and the second mount are vertically spaced apart on the upright frame by a vertical distance corresponding to said prescribed distance.

7. The apparatus according to claim 6 wherein the first axis of the first mount and the second axis of the second mount are aligned with one another within a substantially vertical common plane.

8. The apparatus according to claim 6 wherein the first mount protrudes laterally outwardly from the upright frame by a greater distance than the second mount protrudes laterally outwardly from the upright frame.

9. The apparatus according to claim 1 wherein the upright frame comprises a singular pole extending upwardly from the wheeled base.

10. The apparatus according to claim 1 in combination with a wing blade stand arranged to support the wing blade relative to a ground surface, the wing blade stand comprising:

an arm extending longitudinally between an inner first end and an outer second end, the outer second end being sized for insertion into a lift hook aperture on a rear of the wing blade; and at least one leg connected to the inner first end of the arm to extend downwardly and laterally outwardly away from the arm when the arm is horizontally inserted into the lift hook aperture of the wing blade;

said at least one leg having a height which is sized to support the wing blade in a vertical orientation on the ground surface when said at least one leg is engaged upon the ground surface.

11. A method of using the handling apparatus according to claim 1 for handling the grader wing attachment relative to the grader, the method comprising:

supporting the first support arm of the grader wing attachment within the first mount so that the first support arm extends along a first axis of the first mount;

supporting the second support arm of the grader wing attachment within the second mount so that the second support arm extends along a second axis of the second mount; and rolling the wheeled base transversely to the first and second axes of the first and second mounts so as to pivot the support arms relative to the wing blade and thereby displace the first and second support arms towards or away from the grader.

12. The method according to claim 11 wherein the wheeled base comprises a pair of wheels spaced apart from one another in the rolling direction in which the wheels are oriented along a common arc shaped path having a radius of curvature, the method including supporting the first and second support arms in the first and second mounts at a distance along the support arms from the wing blade that is equal to said radius of curvature.

13. The method according to claim 11 further comprising using a lifting arrangement of the upright frame to vary a height of the first and second mounts relative to the wheeled base to align the first and second support arms with respective mounting locations for the first and second support arms on the grader.

14. The method according to claim 11 further comprising:

providing a wing blade stand arranged to support the wing blade relative to a ground surface, the wing blade stand comprising (i) an arm extending longitudinally between an inner first end and an outer second end, and (ii) at least one leg connected to the inner first end of the arm to extend downwardly and laterally outwardly away from the arm when the arm is horizontally oriented;

inserting the outer second end of the arm into a lift hook aperture on a rear of the wing blade; and engaging said at least one leg on the ground surface such that the wing blade is supported by the wing blade in a vertical orientation on the ground surface.

15. A handling apparatus for a grader wing attachment including a wing blade, a pivot at a first end of the wing blade for pivotal connection to a grader, and first and second support arms for connecting a second end of the wing blade to the grader at a location spaced rearwardly of the pivot, the apparatus comprising:

a wheeled base arranged for rolling movement along the ground in a rolling direction;

an upright frame extending upwardly from the wheeled base;

a first mount supported on the upright frame at a location spaced above the wheeled base, the first mount being arranged to support the first support arm of the grader wing attachment extending along a first axis of the first mount; and a second mount supported on the upright frame at a location spaced above the first mount, the second mount being arranged to support the second support arm of the grader wing attachment extending along a second axis of the second mount;

wherein the rolling direction of the wheeled base is oriented transversely to the first and second axes of the first and second mounts;

wherein at least one of the first mount and the second mount comprises a cradle having an open top end arranged to receive the corresponding support arm of the wing attachment at least partially recessed into the cradle through the open top end.

16. The apparatus according to claim 15 wherein the first mount comprises said cradle and is arranged to receive the first support arm of the wing attachment at least partially recessed into the cradle through the open top end.

17. The apparatus according to claim 15 wherein the second mount comprises said cradle and is arranged to receive the second support arm of the wing attachment at least partially recessed into the cradle through the open top end.

18. A handling apparatus for a grader wing attachment including a wing blade, a pivot at a first end of the wing blade for pivotal connection to a grader, and first and second support arms for connecting a second end of the wing blade to the grader at a location spaced rearwardly of the pivot, the apparatus comprising:

a wheeled base arranged for rolling movement along the ground in a rolling direction;

an upright frame extending upwardly from the wheeled base;

a first mount supported on the upright frame at a location spaced above the wheeled base, the first mount being arranged to support the first support arm of the grader wing attachment extending along a first axis of the first mount; and a second mount supported on the upright frame at a location spaced above the first mount, the second mount being arranged to support the second support arm of the grader wing attachment extending along a second axis of the second mount;

wherein the rolling direction of the wheeled base is oriented transversely to the first and second axes of the first and second mounts;

wherein the upright frame comprises a singular pole extending upwardly from the wheeled base.

* * * * *